United States Patent [19]

Schwarze

[11] Patent Number: 4,563,891

[45] Date of Patent: Jan. 14, 1986

[54] PIPE BENDING MACHINE

[76] Inventor: Rigobert Schwarze, Olpener Str. 460-474, 5000 Köln 91, Fed. Rep. of Germany

[21] Appl. No.: 549,884

[22] Filed: Nov. 4, 1983

[30] Foreign Application Priority Data

Nov. 4, 1982 [DE] Fed. Rep. of Germany ..... 3240799

[51] Int. Cl.[4] ..... B21D 7/04; B21D 9/05

[52] U.S. Cl. ..... 72/149; 72/150; 72/159

[58] Field of Search ..... 72/149, 150, 155, 156, 72/157, 158, 159, 217

[56] References Cited

U.S. PATENT DOCUMENTS

| | | | |
|---|---|---|---|
| 757,593 | 4/1904 | Atwood | 72/150 X |
| 2,762,415 | 9/1956 | Franck | 72/159 X |
| 3,017,917 | 1/1962 | Streit | 72/310 |
| 3,276,235 | 10/1966 | Stanley | 72/158 X |
| 3,287,952 | 11/1966 | Van Harten | 72/150 |
| 3,336,776 | 8/1967 | Zerlaut | 72/156 X |
| 3,475,938 | 11/1969 | Whitney et al. | 72/157 X |
| 4,063,441 | 12/1977 | Eaton | 72/155 X |
| 4,126,030 | 11/1978 | Zollweg et al. | 72/155 X |

FOREIGN PATENT DOCUMENTS

| | | | |
|---|---|---|---|
| 2133359 | 1/1973 | Fed. Rep. of Germany | 72/149 |

*Primary Examiner*—E. Michael Combs
*Attorney, Agent, or Firm*—Michael J. Striker

[57] ABSTRACT

Disclosed is a pipe bending machine which for the purpose of increasing the freedom of bending operation, is provided with a stand which supports longitudinally extending flat supporting beam of a relatively low height. The forwardly projecting part of the supporting beam has a lateral extension supporting for rotation the bending table whose center axis of rotation is laterally offset relative to the side wall of the supporting beam. The bending table has a rotation symmetrical configuration and consists of an inner rotary sleeve which acts simultaneously as a cylinder for lifting a two piece bending die. The drive for the bending table, and the drives for sliding shoe cooperating with the bending die are arranged on the projecting part of the supporting beam in a single structural unit.

11 Claims, 12 Drawing Figures

PIPE BENDING MACHINE

BACKGROUND OF THE INVENTION

The present invention relates to a pipe bending machine of the type having an elongated supporting frame defining two opposite longitudinal sides and a head face, a feeding carriage movable along an upper edge of one longitudinal side of the frame, a collet mounted on the carriage for holding a pipe, a bending table arranged at the head face of the supporting frame to turn about an upright axis of rotation, a bending die secured on the bending table, a clamping jaw and a slide bar arranged in the range of the one longitudinal side of the frame to cooperate respectively with the bending dye.

As known, bending machines of the aforedescribed kind are employed for cold bending of pipes. During this process, a bending core bar can be additionally inserted in the interior of the pipe to be processed.

Bending machines of this construction are suitable particularly for bending pipes of larger diameter which are subject to multiple bending at large bending diameters. In this mode of operation, the bending freedom required from the bending machines is not of particular significance, since in contemporary digitally controlled pipe bending machines the bending freedom that means the precaution that the parts of the pipe do not hit a component part of the machine during the bending process is tested and incorporated in the control program. Pipes of smaller diameter though are bent at smaller bending radii. As a consequence, during the bending operation the danger is present that the bent part of the pipe might strike on the machine. Accordingly, the question of bending freedom in the latter case is of large importance.

SUMMARY OF THE INVENTION

It is therefore a general object of the present invention to provide a pipe bending machine, particularly for use in pipes of smaller diameters, which possesses large freedom of bending.

In keeping with this object and others which will become apparent hereafter, one feature of the invention resides, in the bending machine of the aforedescribed kind, in a combination which comprises supporting means for the bending table arranged at head face of the frame in such a manner that the center axis of rotation of the bending table is arranged in a plane which coincides with the other longitudinal side of the frame opposite the carriage, or is offset outwardly relative to the latter.

In other words, the bending table is supported for rotation outside a vertical plane which is coplanar with the longitudinal side of the supporting frame of the machine opposite the feeding carriage. By virtue of this solution relatively free layout of the bending arrangement is created which yields an improved bending freedom.

In a further elaboration of this invention, the bending die is arranged at the end part of a flat beam-like support extending forwardly in the longitudinal direction of the machine frame at the level of its upper surface so that a free space is left below the bottom surface of the the beam-like support. This construction makes it possible that parts of the bent pipe can protrude also below the cantilever-like beam which supports the bending table. As a consequence a still increased bending freedom is obtained.

In order to design the beam-like support with reduced structural height and with reduced breath at a relatively large length thereof (these factors are significant for achieving large bending freedom), in a further elaboration of this invention the drive for the bending die is arranged transversely to the longitudinal dimension of the machine frame or of the supporting beam and is arranged at the side of the feeding carriage or of the slide bar.

While in prior art pipe bending machines disclosed for example in the German Pat. No. 2,133,359, the drives for the bending table is accommodated within the machine frame to act in the longitudinal direction of the latter, in the machine of this invention the drive for the bending die extend transversely through the longitudinal direction of the machine frame or of the supporting beam and is arranged at the sides of the frame which supports the feeding carriage or the slide bar. Due to this design it is possible to arrange the drive for the bending die in immediate proximity to the bending table.

In a further embodiment of this invention, the drive for the bending die and the drive for the slide bar are accommodated in a single structural unit. The term "structural unit" in this context does not denote a construction part but it denotes the particular arrangement of the drives for the bending table and for the slide bar which is characterized by a common support for the two drives and by a closed spatial arrangement of the latter and that the two parts are interconnected and secured to the common support.

In a further embodiment of this invention it is devised that the structural unit contains a further drive for moving the slide bar in the longitudinal direction of the supporting elongated beam or in tangential direction relative to the bending die.

Preferably, the structural unit is secured to the supporting side of the beam by screws.

In still another embodiment of this invention the drive of the bending die and the drive of the slide bar extend parallel one to another and through a radial direction of the bending die. In order to obtain a layout of the drive for the bending table and for the slide bar which requires a minimum space according to another feature of this invention, the drive for bending die consists of a hydraulic motor whose shaft supports a worm shaft engaging a worm wheel which is in turn drives a sleeve surrounding the bending table.

Another advantageous measure for obtaining a space saving arrangement of the machine of this invention, the drive for slide bar includes hydraulic cylinder and piston unit acting in a radial direction of the bending die, the unit being arranged above and laterally offset from the hydraulic drive for the bending table.

The additional drive of the slide bar acting in the longitudinal direction of the machine frame also consists of a hydraulic cylinder and piston unit which is arranged above the hydraulic motor and extends transversely to the driving shaft of the latter.

In order to still further increase the bending freedom of the machine the bending table has a rotation symmetrical configuration which occupies a minimum space.

In a further embodiment of this invention the bending table is arranged in a housing which supports also the driving worm gear and which is fastened by screws to the side wall of the flat beam-like support. The advantage of this measure is not only the fact that the rotary axle of the bending table on the beam-like support is located in an offset relationship to the other side wall of the frame, but also a simpler manufacture and installation of the machine is achieved.

In a further embodiment of this invention it is devised that the bending table is assembled of an outer jacket and of an inner sleeve, the latter supporting on its circumferential part approximately midway of the height of the table, the worm gear engaging the worm on the hydraulic motor.

The invention further provides measures by means of which parts of the machines are simplified and arranged in spatially more advantageous manner to obtain a greater freedom of bending operation.

In conventional pipe bending machines the bending table which supports the bending die is provided with a pivot arm which supports for a reciprocating movement in radial direction to the die a clamping jaw and its drive. In contrast, in the bending machine according to this invention the bending table is in the form of a rotationally symmetrical body, the reciprocating movement of the clamping jaw in radial direction relative to the bending die is dispensed with and the pipe is fixed to the bending die in a new manner. For this purpose, according to a further embodiment of this invention, the sleeve of the bending table is constructed as a cylinder in which a double-acting piston is axially displacable whereby the piston is formed with an axially upwardly directed piston rod projecting from the sleeve. The bending die which is secured on top of the sleeve is made of two pieces separated in a horizonal plane passing through the center of a peripheral groove, thus dividing the die in a lower bending die part and upper bending die part. The lower bending die part is secured to the top part of the sleeve and the upper die part is secured to the projecting tip of the piston rod. Due to this measure the swinging arm of prior art machines which impairs the freedom of bending operation, can be eliminated inasmuch for clamping the pipe in the peripheral groove of the bending die the upper part is moved by the piston in axial direction. A particular advantage in this axially acting clamping arrangement is achieved by the measure that the upper bending die part is formed on a portion of its periphery with an overhanging collar which is shaped with a semicircular groove cooperating with the groove portion on the lower die part to serve as a clamping jaw. In a preferred embodiment of this clamping collar, the latter is provided with a downwardly directed extension overlapping the lower bending die part.

For a further increase of the bending freedom it is devised that the upper part of the bending table projecting above the upper surface of the supporting head beam is tapered at sharp angle and preferably the lower part of the bending die has also a conical base matching the tapered part of the table.

For mounting the bending die on the bending table there is provided, according to an additional feature of this invention, a conical ring covering the tapering surfaces of the upper part of the bending table and of the lower part of the bending die and being rigidly secured to the latter so as to firmly hold these parts together.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
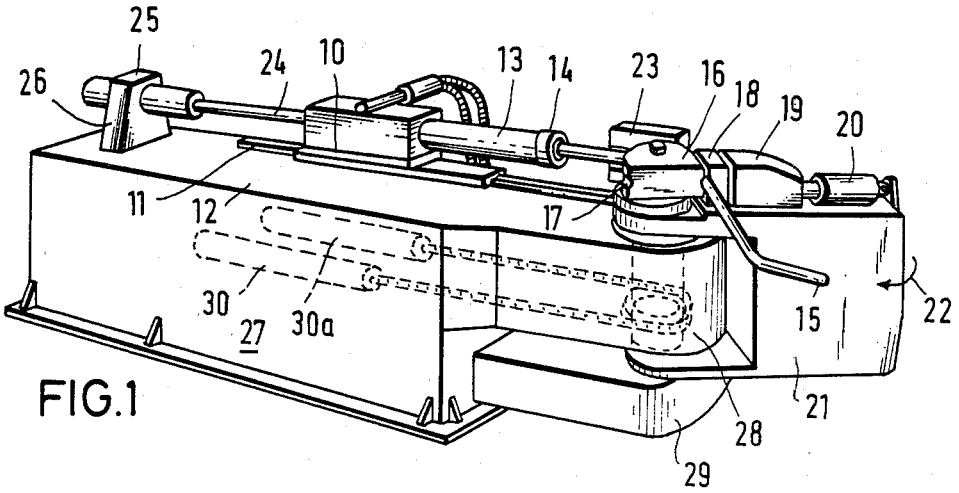
FIG. 1 is a perspective of a known, generally used pipe bending machine.

FIG. 1 shows a prior art pipe bending machine which includes a pipe feeding carriage 10 movable back and forth on one or more guiding rails 11 arranged on the upper of a machine frame 12. The feed carriage 10 supports a pipe holding cylinder 13 and a clamping sleeve 14 in which the pipe to be bent is clamped. The pipe 15 is then fed past a pivotably supported bending die 16 having along its periphery a groove 17 matching the diameter of the pipe. The pipe is pressed in the groove 17 by clamping jaw 18, the latter being mounted on a clamping device 19 driven by a hydraulic cylinder 20. The clamping unit 19 with the jaw 18 and the hydraulic cylinder 20 are supported on a pivot arm 21 of a bending table, whereas the bending die 16 is secured to the bending table coaxially with its axis of rotation. The bending operation proceeds in the direction of arrow 22. Reference numeral 23 denotes a slide bar. Within the processed pipe 15 there is arranged in the range of the slide bar 23 a bending core secured at its trailing end to a core rod 24. The core rod 24 is held in position by a core retrieving device 25 mounted on a bearing block 26. The machine frame 27 has an elongated configuration which at its head face is provided with a forwardly projecting extension 28. Reference numeral 29 indicates casing for a chain drive for returning the bending die to its starting position. The drive for the bending table includes a driving chain accommodated within the projecting extension 28 and activated by two cylinder and piston units 30 and 31 arranged within the machine frame 27. The disadvantage of this prior art construction is a relatively limited freedom of bending operation due to the excessive height of the projection 28 and due to the arrangement of casing 29 which also impairs the freedom of bending.

Figure 2:
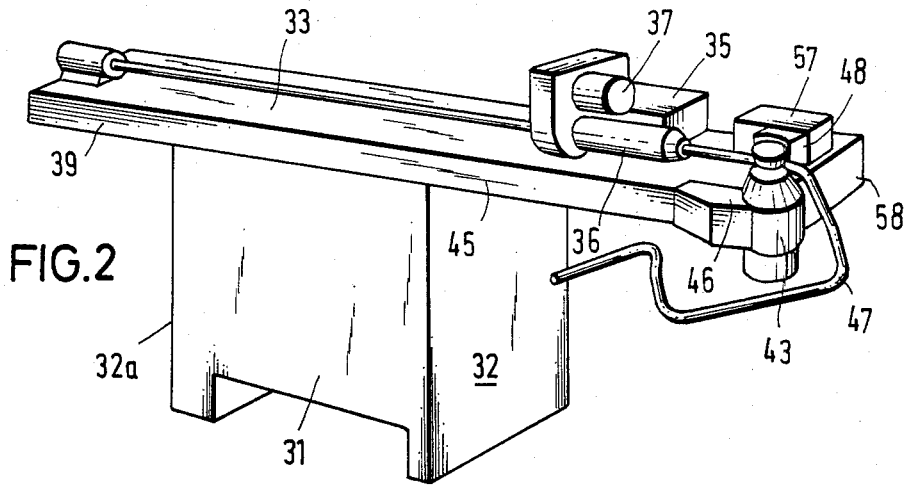
FIG. 2 is a perspective view of the pipe bending machine of this invention.

FIG. 2 shows the arrangement of the bending machine according to this invention. The machine has identical basic elements as the prior art machine according to claim 1, namely the feed carriage, clamping sleeve, bending table, bending die, slide bar and clamping jaw which however in the following description will be denoted by different reference numerals.

The machine frame 31 has the form of a quadrangular prism defining two opposite end faces 32 and 32*a* and being integrally connected on its top side with an elongated supporting beam 33 having a flat configuration and considerably exceeding in length the machine frame to form cantilevers overlapping the respective end faces 32*a* and 32. The supporting beam 33 is provided on its top surface with a guiding rail 34 for the feed carriage 35, the latter being provided as in the preceding example with the clamping sleeve 36. The clamping sleeve is activated by a hydraulic motor 37 arranged above the clamping sleeve.

In order to adjust the feeding arrangement to different diameters of the bending die, the feed carriage 35 is provided with a short rail 38 for displacing the clamping sleeve in a direction transverse to the feeding direction. Similar transverse rail 40 is provided at the rearwardly projecting part 39 of the supporting beam 33 so that the core retrieving device 42 together with the core rod 41 might be displaced transversely to the feeding direction.

The forwardly projecting part of the supporting beam supports a bending table 43 which as it will be described in greater detail below, has a rotation symmetrical configuration and does not use any pivot arm.

Figure 3:
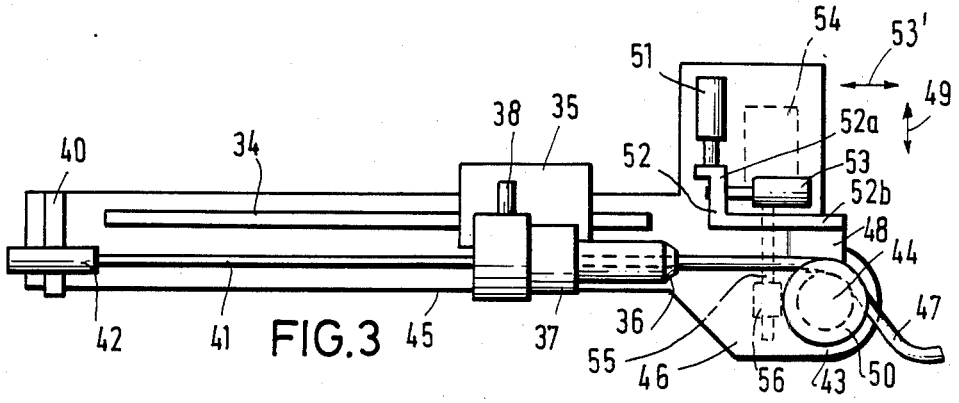
FIG. 3 is a top view of the machine of FIG. 2.

The pivot axis 44 coinciding with the center of rotation of the axle is located in close range to a vertical frame coinciding with the upright side wall 45 of the supporting beam 33 or the corresponding side wall of the machine frame 31. As illustrated in FIG. 3, the forward extension of the supporting beam 33 is formed with a lateral shoulder 46 projecting beyond the plane of the lateral upright side 45 of the beam and supporting the bending table.

As it will be seen from FIG. 2, the cantilever arrangement of the machine frame 31 with the projecting supporting beam 33 provides sufficient free space in front of the head face 32 of the frame for substantially increasing the operational freedom during the bending operation. Due to the space resulting also from the relatively low height of the projecting part of the beam, the pipe 47 can now be bent in such a manner that the deformed pipe portion can freely move below the bending table and below the bottom of the projecting part of the beam 33.

Reference numeral 48 indicates a sliding bar which is movable in two opposite radial directions, indicated by double arrow 49 to and from a bending die 50 which is mounted on the top of the bending table 43. The sliding bar 48 is moved by a hydraulic cylinder and piston unit 51. For transmitting the movement of the driving piston on the sliding bar, there is provided an angular transmission piece 52 formed with arms 52*a* and 52*b*. Another cylinder and piston unit 53 acts transversely to the drive 51 and serves for moving the sliding bar in longitudinal direction of the supporting beam as indicated by arrow 53 and moves in tangential direction relative to the bending die so that the sliding bar might travel simultaneously with the pipe during its bending.

The bending table 43 and thus the bending die 50 mounted thereon are rotated by a hydraulic motor 54 and a worm gear transmission 55 and 56 indicated by dashed line in FIG. 3.

The spatial arrangement of the hydraulic drives 51, 53 and 54 is only schematically indicated in FIG. 3. Actually they form a structural unit 57, 58 which will be explained in detail below in connection with FIGS. 4 to 7.

Figure 4:
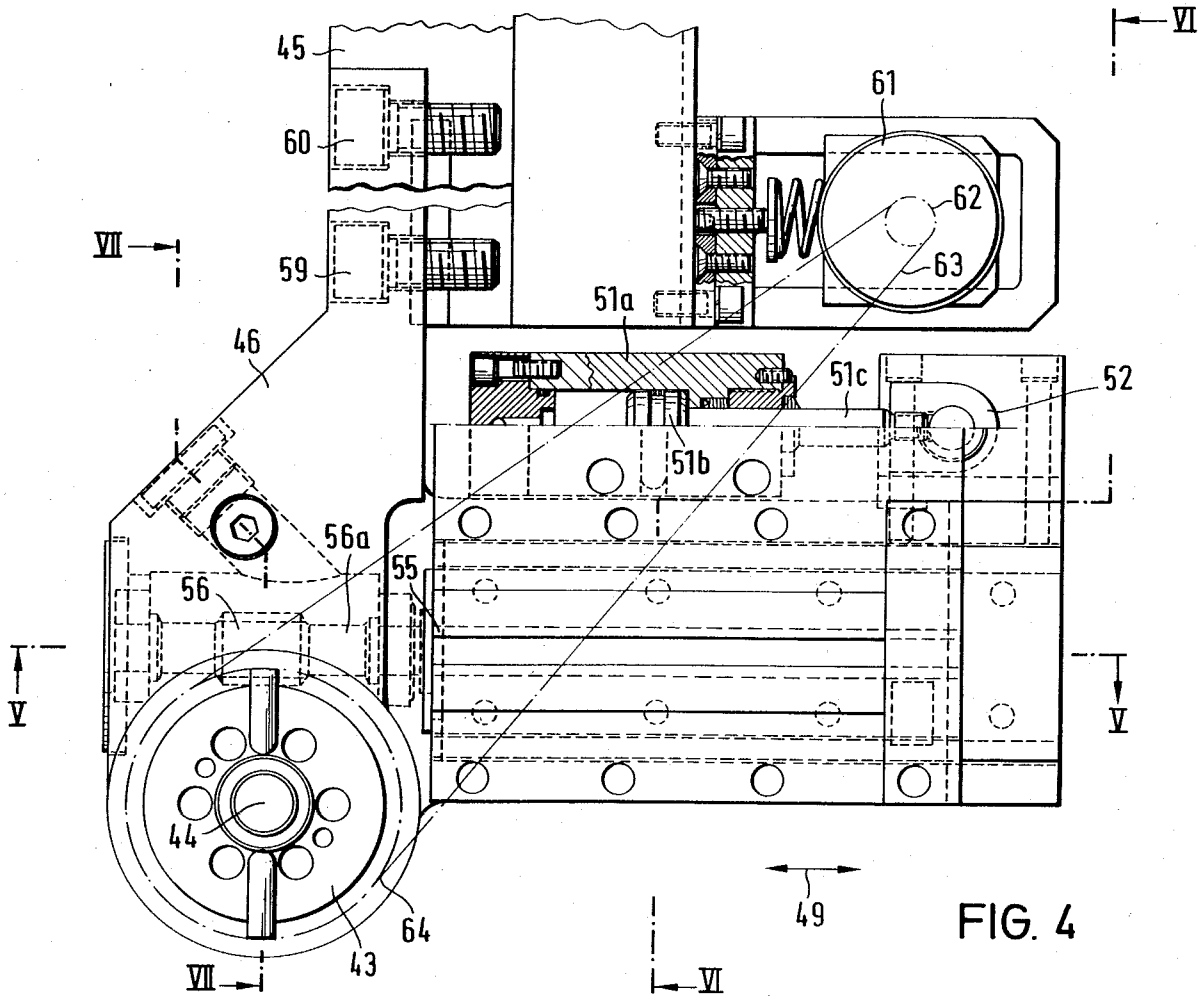
FIG. 4 is a top view, on an enlarged scale, of the driving means for the bending table and the slide bar.

FIG. 4 illustrates the lateral shoulder 46 for supporting the bending table 43. The shoulder is secured by screws 59 and 60 to the side wall 45 of the supporting beam 43. Due to this arrangement the axis of rotation 44 of the bending table is offset outwardly relative to the side wall 45. Reference numeral 56 denotes a worm shaft attached to a shaft 55 of a hydraulic motor 54 (FIG. 3). The supporting beam supports a cylinder and piston unit 51 consisting of a cylinder 51*a*, a piston 51*b* and a piston rod 51*c* and mounted on a support 52 which as apparent from FIG. 3 has a different spatial arrangement nevertheless the same function inasmuch as it moves in two opposite directions indicated by double arrow 49, a sliding bar (not visible in FIG. 4) to bring the latter in contact with the processed pipe or withdraw it from the pipe.

Rotary member 61 which is provided at its lower end with a sprocket wheel 62 is connected via a chain 63 with a sprocket wheel 64 on the rotation symmetrical bending table 43. The rotary member 61 thus detects the momentary angular movement of the bending table.

Figure 5:
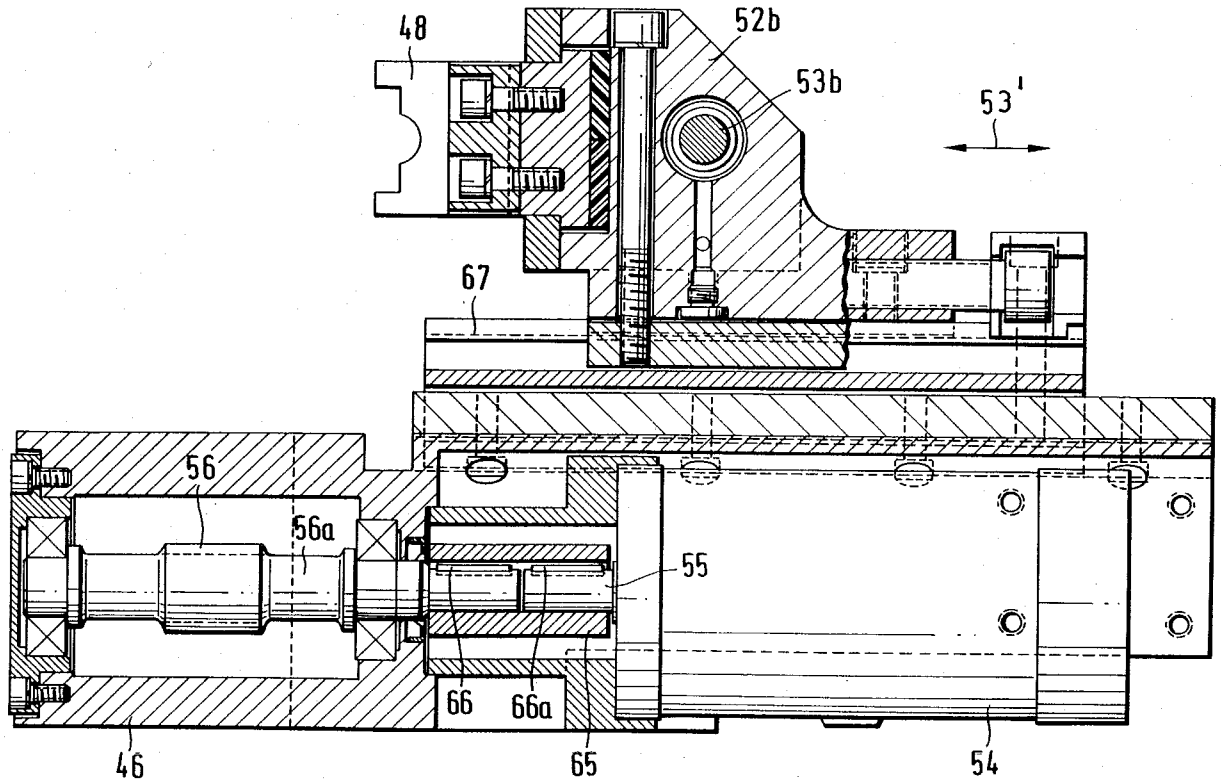
FIG. 5 is a sectional side view of the arrangement of FIG. 4 taken along the line V—V.

FIG. 5 illustrates the hydraulic motor 54 with its driving shaft 55 which is connected via a sleeve 65 and the corresponding keys 66 and 66*a* to the worm shaft 66*a* of the worm gear 66. The worm shaft 66*a* is arranged as mentioned before in the housing of shoulder 46 with the bending table.

FIG. 5 illustrates further the sliding bar 48 supported in a transmission arm 52*b*. The latter as it will will be seen from FIG. 3, is movable back and forth as indicated by double arrow 49 in radial direction to the bending die 50. The transmission arm 52*b* is driven by the cylinder 51*a* whose piston rod 51*c* is arranged to the transmission 52. Since the piston is actuated from both sides, the cylinder 51*a* which is fixedly connected to the sliding bar moves the latter in the indicated directions. FIG. 4 illustrates the position of the sliding bar in which it engages the pipe to be bent in the die. The reciprocating movement of the sliding bar 48 is guided by a guiding rail 67 (FIG. 5).

Figure 6:
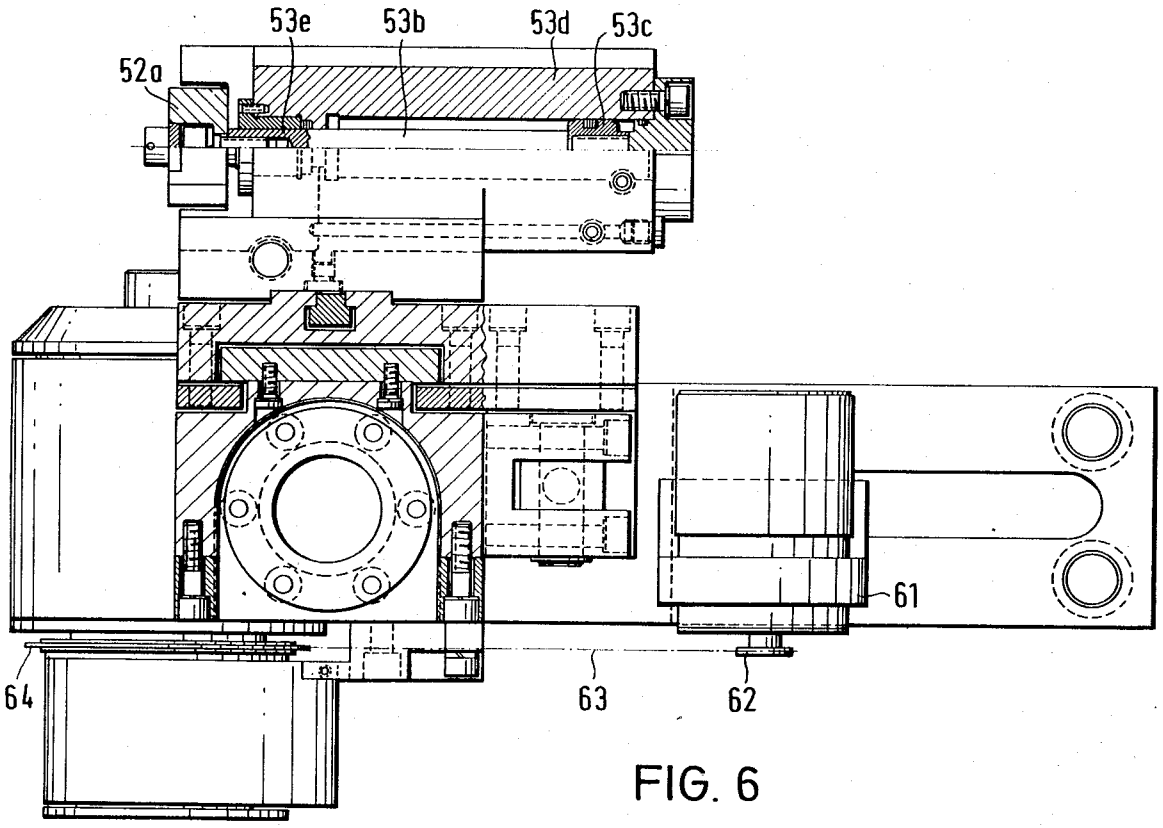
FIG. 6 is a sectional side view of the arrangement of FIG. 4 taken along the line VI—VI.

The movement of the sliding bar 48 in the longitudinal direction of the supporting beam 33 and hence its coordinated travel with the clamped pipe is effected by a piston rod 53*b* (FIG. 5) of the cylinder and piston unit 53 (FIG. 3). The piston 53*c* of the latter unit is shown in FIG. 6 and similarly as piston 51*b* is also activated from both sides to move in cylinder 53*c* in two opposite directions. The piston rod 53*b* is connected at its free end to the arm 52*a* of the transmission member connected to the sliding bar 48, as shown in principle in FIG. 3.

FIG. 6, similarly as FIG. 4 shows the rotation indicator 61 provided below the bottom of the support with a chain drive including the sprocket wheel 62, chain 63 and sprocket wheel 64 at the bending table.

Figure 7:
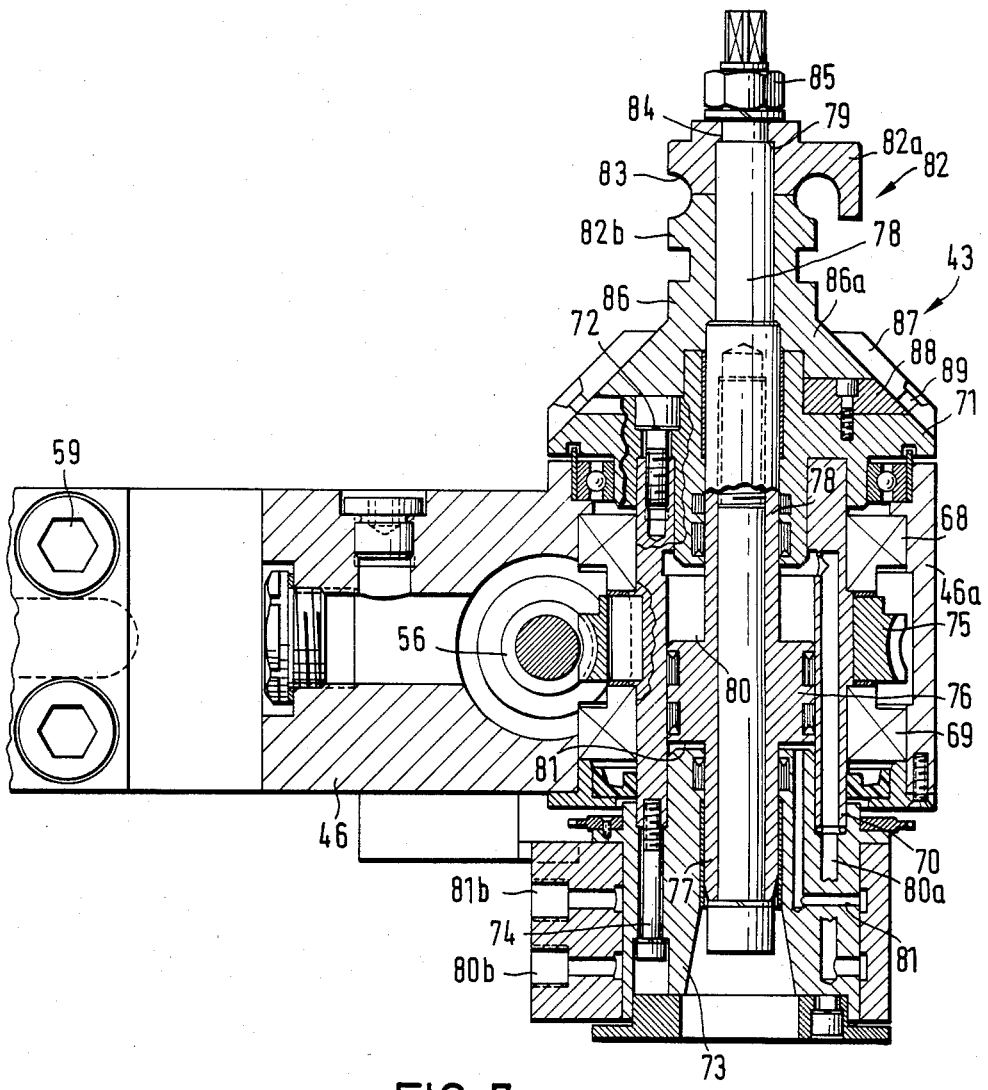
FIG. 7 is a sectional side view of the bending table of FIG. 4 taken along the lines VII—VII.

FIG. 7 illustrates in detail the design of the rotation symmetrical bending table 43 of this invention. As disclosed before, the bending table is supported for rotation in a lateral shoulder 46 of the projecting beam 33. The front end face 46*a* of the shoulder is in the form of a removable jacket which holds in position two conical roller bearings 68 and 69 supporting for rotation an inner sleeve 70 of the table. A frustoconical cover 71 is secured to the top end face of the sleeve 70 by screws 72 whereas the lower annular end face of the sleeve is secured by screws 74 to an annular socket or insert 73. A worm wheel 75 is attached to the circumferential portion of the sleeve between the roller bearings 68 and 69 to engage the worm shaft 66 of the hydraulic motor 54. According to one feature of this invention, the table sleeve 70 is in the form of a hydraulic cylinder accommodating in its interior a double acting piston 76. The piston is integrally connected with a downwardly projecting piston rod 77 serving as a guide and with an upwardly projecting piston rod 78 protruding above the frustoconical cover 71 and being reduced in diameter at its free end to form a flange 79. The piston 76 delimits two cylindrical spaces 80 and 81 of which the cylindrical space 80 is connected via a passage 80*a* to an inlet 80*b* for pressure fluid; the other cylinder space 81 is connected via a passage or channel 81*a* with another inlet 81*b*. When the inlet 80*b* is supplied with pressure oil, then the volume of cylindrical space 81 is increased and the piston together with its piston rod 78 is moved upwards.

The bending die 82 consists of an upper bending part 82*a* and a lower bending die part 82*b* separated by a horizontal separation plane intersecting the center of a holding groove 83. The upper die part 82*a* has also an inner flange resting on the flange 79 and being secured to the piston rod 78 by means of screw nut 85.

The lower die part 82 is extended into a conical shape matching the conical surface of the underlying cover 71. The connection of the tapering part 86*a* of the lower die part 82 and of the cover 71 is made by means of a conical ring 87 secured to the former parts by means of a key 88 and screws 89. Preferably the ring which provides rigid connection between the bending table and the bending die 82 is also assembled of two halves.

Figure 9:
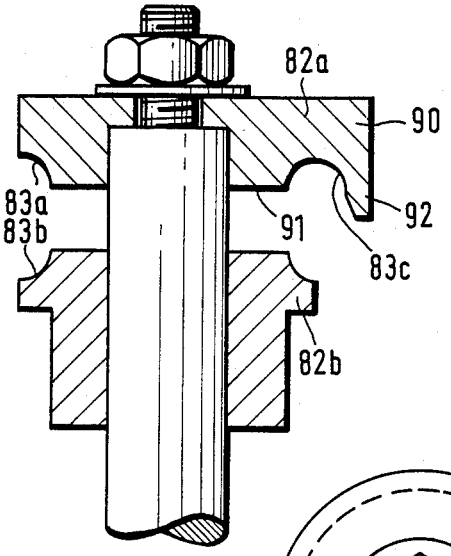
FIG. 9 is a sectional side view of the open bending die.
Figure 8:
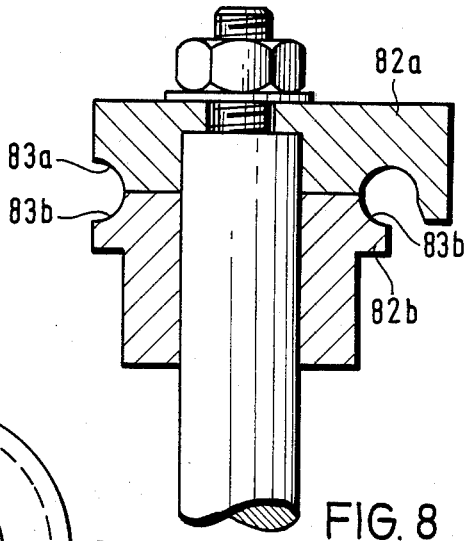
FIG. 8 is a sectional side view of the closed bending die.
Figure 10:
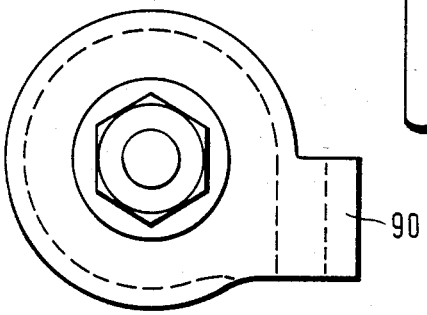
FIG. 10 is a top view of the bending die of FIG. 8.

When by supplying pressure fluid in the inlet 81*b* the piston with its piston rod 78 is lifted then the upper die part 82*a* is also lifted. Conversely, when pressure oil is supplied in the inlet 80*b* then the piston 76 is moved downwards and the upper part 82*a* of the bending die abuts against the lower die part 82*b*. The open and closed positions of the bending die are illustrated in FIGS. 8 and 9. Both parts of the bending die have their opposite circumferential edges recessed in the form of quadrant grooves 83*a* and 83*b*. In order to produce a firm clamping of the pipe to be bent, a circumferential portion of the upper die 82*a* is provided with an outwardly projecting collar 90 which defines a groove 83*c* of semicircular cross-section. Preferably, the collar 90 transits in an extension 92 overhanging downwardly both bending die halves.

The aforedescribed combination of the upper and lower die halves serves as a clamping jaw for firmly holding the pipe on the bending die.

Figure 11:
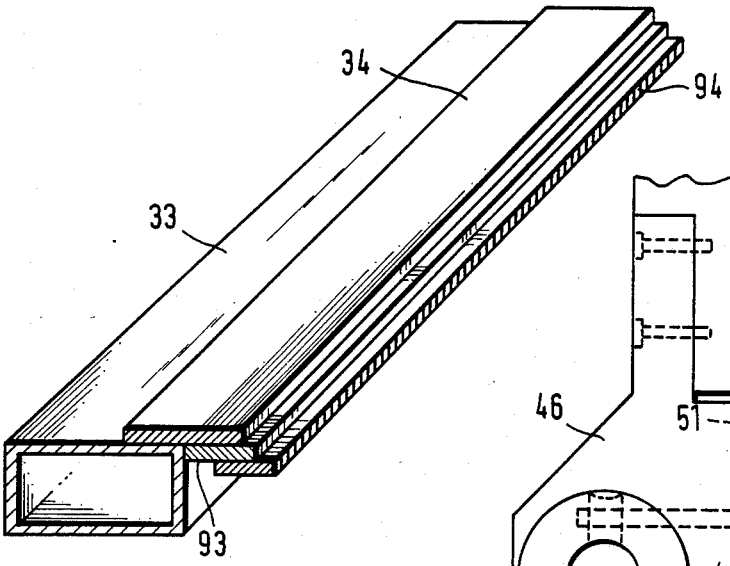
FIG. 11 is a perspective view, partly in section, of the support for the bending die and the slide bar.

FIG. 11 illustrates the supporting flat beam 33 which is in the form of a rectangular pipe. A flat rail 34 overlaps one lateral side of the beam 33 and is secured to the upper side of the latter by welding. The overlapping lower surface of the rail 34 is connected by welding to an intermediate flat rail 93 and a tooth rack 94, serving for driving feed carriage 35 is secured by welding to the bottom surface of the intermediate rail 93.

Figure 12:
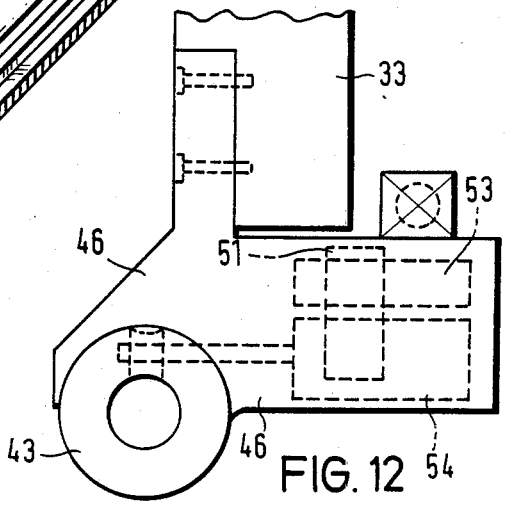
FIG. 12 is a top view of a structural unit for mounting the bending die and the slide bar on the support.

FIG. 12 shows the attachment of the supporting shoulder 46 to a lateral side of the supporting beam 33. The shoulder 46 has a rectangular cutout one arm of which is secured to the beam 33 by screws and the other arm serves as a structural unit for supporting both the bending table 43 and the drives 54, 51 and 53.

The length of the flat supporting beam 33 in the pipe bending machine of this invention (FIG. 2) has preferably the length between 3 to 4 meters and the supporting machine frame has a height of about 1 meter. The supporting beam 33 (FIGS. 11 and 12) has a breadth of about 15 centimeters and a height of about 10 centimeters. The guiding rail 34 is about 12 centimeters of width.

It will be understood that each of the elements described above, or two or more together, may also find a useful application in other types of constructions differing from the types described above.

While the invention has been illustrated and described as embodied in a specific example of a pipe bending machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A pipe bending machine comprising a supporting frame, defining an upper side, two opposite longitudinal sides and a head face, a flat beam secured to said upper side of the frame and having a projecting portion extending forwardly in longitudinal direction of the frame past said head face to leave free space underneath; a feeding carriage movable along an upper edge of one longitudinal side of the frame; a collet mounted on the carriage for holding a pipe; a bending table of a rotation symmetrical configuration arranged on said projecting portion of the flat beam to turn about an upright axis of rotation; a bending die secured on the bending table; a clamping jaw and a slide bar arranged opposite the bending die to cooperate therewith; first driving means arranged on said frame at said one longitudinal side thereof, said first driving means being coupled to said slide bar to move the same in two opposite radial directions relative to said upright axis of rotation and in the longitudinal direction of the frame; second driving means including a hydraulic motor having a shaft provided with a worm shaft extending transversely to the longitudinal direction of the frame, and the bending table being provided with a circumferential worm gear engaging said worm shaft; said first driving means for the slide bar including a hydraulic cylinder and piston unit which is arranged above said hydraulic motor to act in said opposite radial directions, and an additional hydraulic cylinder and piston unit arranged above the hydraulic motor to act in said longitudinal direction; said bending table including an outer housing and a sleeve within said housing, said sleeve being constructed as a hydraulic cylinder in which a double sided piston is arranged for reciprocating axial movement, the piston being provided with an upwardly directed piston rod projecting out of the sleeve; said bending die being assembled of an upper die part and a lower die part separated by a horizontal separation plane, the lower die part being connected to a top part of said sleeve and the upper die part being connected to a projecting part of said piston rod, and the bending die being formed in the region of its separating plane with a circumferential groove for accommodating a pipe.

2. A bending machine as defined in claim 1, wherein said first driving means for the slide bar, said second driving means for the bending table and the bending table are arranged in a single structural unit which is mounted on said projecting portion of the flat beam.

3. A pipe bending machine as defined in claim 1, wherein said housing of the bending table supports for rotation said worm wheel, said housing being secured to a side wall of said flat beam.

4. A pipe bending machine as defined in claim 1, wherein said worm wheel is arranged about midway of the height of the bending table.

5. A pipe bending machine as defined in claim 1, wherein a peripheral sector of the upper die part is formed with a radially projecting collar provided with a groove for clamping a pipe.

6. A pipe bending machine as defined in claim 5, wherein said collar is formed with a downwardly directed extension overlapping the peripheral groove of the die.

7. A pipe bending machine as defined in claim 1, wherein a part of the bending table projecting above the upper surface of the flat beam has a conical configuration, and the lower part of the die having tapered form matching the conical configuration of the table.

8. A pipe bending machine as defined in claim 7, further comprising a conical ring covering the tapering lower part of the bending die, and the upper conical part of the bending table and being disconnectably secured to these parts.

9. A pipe bending machine as defined in claim 1, further comprising a chain wheel arranged on the part of the rotation symmetrical bending table below the projecting portion of the flat beam and being connected via a chain with an indicator arranged on said flat beam.

10. A pipe bending machine as defined in claim 1, wherein said flat beam is formed of a tube of a rectangular cross-section, said frame supporting on its upper side a guiding rail for the feeding carriage, said guiding rail projecting over the rectangular tube and being welded thereto.

11. A pipe bending machine as defined in claim 10, wherein a toothed rail is secured by welding to a lower side of said guiding rail, the teeth of the toothed rail projecting laterally beyond the edge of said guiding rail.

* * * * *